US010591836B2

(12) United States Patent
Uchihashi

(10) Patent No.: US 10,591,836 B2
(45) Date of Patent: Mar. 17, 2020

(54) TONER

(71) Applicant: KYOCERA Document Solutions Inc., Osaka (JP)

(72) Inventor: Yuma Uchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/381,175

(22) Filed: Apr. 11, 2019

(65) Prior Publication Data

US 2019/0324377 A1 Oct. 24, 2019

(30) Foreign Application Priority Data

Apr. 23, 2018 (JP) ..... 2018-082387

(51) Int. Cl.
*G03G 9/093* (2006.01)
*G03G 9/08* (2006.01)

(52) U.S. Cl.
CPC ..... *G03G 9/09371* (2013.01); *G03G 9/09321* (2013.01); *G03G 9/09328* (2013.01); *G03G 9/0819* (2013.01)

(58) Field of Classification Search
CPC ..... G03G 9/09321; G03G 9/09371; G03G 9/09328
See application file for complete search history.

(56) References Cited

U.S. PATENT DOCUMENTS

2005/0271964 A1 12/2005 Etou et al.
2015/0168859 A1* 6/2015 Matsui ..... G03G 9/0836 430/108.3

(Continued)

FOREIGN PATENT DOCUMENTS

JP 2004-294469 A 10/2004

OTHER PUBLICATIONS

Matyjaszewski, K.; Miller, P.J.; Pyun, J.; Kickelbick, G.; Diamanti, S. "Synthesis and Characterization of Star Polymers with Varying Arm Number, Length, and Composition from Organic and Hybrid Inorganic/Organic Multifunctional Initiators" Macromolecules 1999, 32, 6526-6535 (Year: 1999).*

*Primary Examiner* — Christopher D Rodee
(74) *Attorney, Agent, or Firm* — Studebaker & Brackett PC

(57) ABSTRACT

A toner includes toner particles. The toner particles each include a toner core containing a binder resin and a shell layer covering a surface of the toner core. The shell layers contain a branched macromolecule. The branched macromolecule includes a repeating unit having an oxazoline group. The branched macromolecule satisfies a relationship represented by $r_B/r_L \leq 0.80$, where $r_B$ represents a radius of gyration of the branched macromolecule when an absolute molecular weight of the branched macromolecule is 40,000, and $r_L$ represents a radius of gyration of a linear macromolecule including a main chain having the same structure as a main chain of the branched macromolecule when an absolute molecular weight of the linear macromolecule is 40,000. $r_B$ and $r_L$ are each a radius of gyration measured by gel permeation chromatography using a multi-angle laser light scattering detector.

5 Claims, 3 Drawing Sheets

(56) References Cited

U.S. PATENT DOCUMENTS

| | | | | |
|---|---|---|---|---|
| 2016/0187796 | A1* | 6/2016 | Tsujihiro | G03G 9/09328<br>430/110.2 |
| 2017/0242360 | A1* | 8/2017 | Nishitera | G03G 9/09371 |
| 2018/0210357 | A1* | 7/2018 | Tsujihiro | G03G 9/09328 |
| 2019/0121252 | A1* | 4/2019 | Komada | G03G 9/09725 |

* cited by examiner

TONER

INCORPORATION BY REFERENCE

The present application claims priority under 35 U.S.C. § 119 to Japanese Patent Application No. 2018-082387, filed on Apr. 23, 2018. The contents of this application are incorporated herein by reference in their entirety.

BACKGROUND

The present disclosure relates to a toner.

A known toner includes capsule toner particles. The capsule toner particles each include a toner core and a shell layer covering a surface of the toner core. The toner can exhibit excellent heat-resistant preservability through the shell layers covering the toner cores.

SUMMARY

A toner according to an aspect of the present disclosure includes toner particles. The toner particles each include a toner core containing a binder resin and a shell layer covering a surface of the toner core. The shell layers contain a branched macromolecule. The branched macromolecule includes a repeating unit having an oxazoline group. The branched macromolecule satisfies a relationship represented by $r_B/r_L \leq 0.80$, where $r_B$ represents a radius of gyration of the branched macromolecule when an absolute molecular weight of the branched macromolecule is 40,000, and $r_L$ represents a radius of gyration of a linear macromolecule including a main chain having the same structure as a main chain of the branched macromolecule when an absolute molecular weight of the linear macromolecule is 40,000. $r_B$ and $r_L$ are each a radius of gyration measured by gel permeation chromatography using a multi-angle laser light scattering detector.

DETAILED DESCRIPTION

Figure 1:
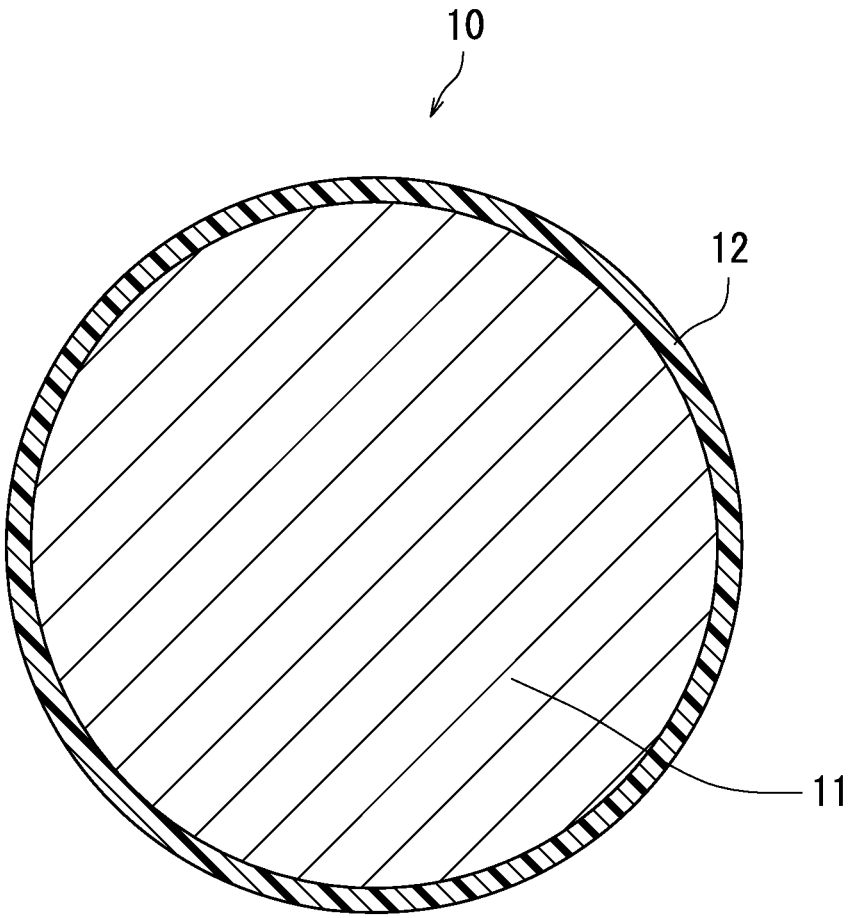
FIG. 1 is a diagram illustrating an example of a cross-sectional structure of a toner particle included in a toner according to an embodiment of the present disclosure.

The following describes a preferred embodiment of the present disclosure. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles) are each a number average of values measured for a suitable number of particles selected from the powder.

A value for volume median diameter ($D_{50}$) of a powder is measured using a laser diffraction/scattering particle size distribution analyzer ("LA-950", product of Horiba, Ltd.), unless otherwise stated. A number average primary particle diameter of a powder is a number average of equivalent circle diameters of primary particles (Heywood diameter: diameters of circles having the same areas as projected areas of the primary particles) measured using a scanning electron microscope ("JSM-7401F", product of JEOL Ltd.), unless otherwise stated. A number average primary particle diameter of a powder is for example a number average of equivalent circle diameters of 100 primary particles of the powder. Note that a number average primary particle diameter of a powder refers to a number average primary particle diameter of particles in the powder (number average primary particle diameter of the powder), unless otherwise stated.

Chargeability refers to chargeability in triboelectric charging, unless otherwise stated. Strength of positive chargeability (or strength of negative chargeability) in triboelectric charging can be confirmed from a known triboelectric series or the like. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after the triboelectric charging using for example a charge meter (Q/m meter). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) plotted using a differential scanning calorimeter ("DSC-6220", product of Seiko Instruments Inc.), unless otherwise stated. Such an endothermic peak results from melting of a crystalline region. A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection caused due to glass transition (specifically, a temperature at an intersection point between an extrapolation of a base line and an extrapolation of an inclined portion of the curve) corresponds to the glass transition point (Tg).

An acid value is measured in accordance with "Japanese Industrial Standard (JIS) K0070-1992", unless otherwise stated.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" is used as a generic term for both acrylonitrile and methacrylonitrile. An organic group "optionally substituted with a substituent" means that some or all of hydrogen atoms of the organic group may each be replaced with a substituent. An organic group "optionally substituted with a phenyl group" means that some or all of hydrogen atoms of the organic group may each be replaced with a phenyl group. The term "branched macromolecule" as used herein refers to a macromolecule having a branched structure. The term "linear macromolecule" as used herein refers to a macromolecule having a linear structure.

<Toner>

A toner according to the present embodiment can for example be favorably used as a positively chargeable toner in development of electrostatic latent images. The toner according to the present embodiment is a collection (for example, a powder) of toner particles (particles each having features described below). The toner may be used as a one-component developer. Alternatively, a two-component developer may be prepared by mixing the toner and a carrier using a mixer (for example, a ball mill).

The toner particles included in the toner according to the present embodiment each include a toner core containing a binder resin and a shell layer covering a surface of the toner core. The shell layers contain a branched macromolecule. The branched macromolecule includes a repeating unit having an oxazoline group. The branched macromolecule satisfies a relationship represented by $r_B/r_L \leq 0.80$, where $r_B$ represents a radius of gyration of the branched macromolecule when an absolute molecular weight of the branched macromolecule is 40,000, and $r_L$ represents a radius of gyration of a linear macromolecule including a main chain having the same structure as a main chain of the branched macromolecule when an absolute molecular weight of the linear macromolecule is 40,000. $r_B$ and $r_L$ are each a radius of gyration measured by gel permeation chromatography (also referred to below as "GPC-MALLS") using a multi-angle laser light scattering detector. The radius of gyration is measured by GPC-MALLS according to the same method described below in association with Examples or a method conforming therewith. The radius of gyration of a macromolecule is an indicator of the degree of branching of the macromolecule. A macromolecule having a smaller radius of gyration has a higher degree of branching. The term "higher degree of branching" of a macromolecule as used in the present specification means that the macromolecule has more branch points per molecule thereof.

The term "main chain" as used in the present embodiment refers to a linear chain including a repeating unit having an oxazoline group. The "linear macromolecule including a main chain having the same structure as the main chain of the branched macromolecule" refers to a linear macromolecule synthesized using the same monomers and the same monomer ratio as in synthesis of the branched macromolecule. Note that the main chain does not include a unit derived from a polymerization initiation group-containing compound. The linear macromolecule including a main chain having the same structure as the main chain of the branched macromolecule is also referred to below as "a linear macromolecule corresponding to the branched macromolecule (or a "corresponding linear macromolecule").

Having the above-described features, the toner according to the present embodiment exhibits excellent heat-resistant preservability while ensuring its low-temperature fixability. The reason for the above is thought to be as follows.

The shell layers of the toner particles included in the toner according to the present embodiment contain a branched macromolecule. The ratio ($r_B/r_L$) between $r_B$ of the branched macromolecule and $r_L$ of the corresponding linear macromolecule is no greater than 0.80. That is, the branched macromolecule in the shell layers of the toner particles included in the toner according to the present embodiment has a relatively high degree of branching. Energy of steric repulsion between molecules of a macromolecule tends to increase with an increase in the degree of branching of the macromolecule. It is therefore thought that the branched macromolecule having a high degree of branching tends not to agglomerate during shell layer formation for production of the toner according to the present embodiment, achieving a relatively high shell layer coverage ratio on the surfaces of the toner cores. As a result, the toner according to the present embodiment has excellent heat-resistant preservability.

The branched macromolecule in the shell layers of the toner particles included in the toner according to the present embodiment includes a repeating unit having an oxazoline group. Accordingly, the shell layers are expected to be able to uniformly cover the surfaces of the toner cores in the toner particles included in the toner according to the present embodiment even if the amount of the shell layers relative to the toner cores is small. Thus, the toner according to the present embodiment can ensure its low-temperature fixability.

In order to obtain a toner having further improved heat-resistant preservability while ensuring low-temperature fixability of the toner, the amount of the shell layers is preferably at least 0.1 parts by mass and no greater than 1 part by mass relative to 100 parts by mass of the toner cores.

Each shell layer does not need to entirely cover the surface of the corresponding toner core. That is, the shell layer does not need to cover 100% of a surface area of the toner core as long as the shell layer covers the surface of the toner core to the extent that the binder resin can be prevented from bleeding out of the toner core (particularly, to the extent that a low-molecular component of the binder resin can be prevented from bleeding out of the toner core). Preferably, at least 90% and no greater than 100% of the surface area of the toner core is covered with the shell layer (shell layer coverage ratio). More preferably, at least 95% and no greater than 100% of the surface area of the toner core is covered with the shell layer. As a result of each shell layer covering at least 90% of the surface area of the corresponding toner core, the toner can have further improved heat-resistant preservability.

The shell layer coverage ratio can be measured by analyzing transmission electron microscope (TEM) images of cross-sections of the toner particles using commercially available image analysis software (for example, "WinROOF", product of Mitani Corporation). Specifically, in a TEM image of a cross-section of a dyed toner particle, the shell layer coverage ratio can be obtained by measuring a percentage of an area covered with the shell layer out of the surface area of the toner core (an area defined by an outline representing a periphery of the toner core).

The toner cores may further contain an internal additive (for example, at least one of a colorant, a releasing agent, a charge control agent, and a magnetic powder) as necessary in addition to the binder resin.

The toner particles included in the toner according to the present embodiment may include an external additive. In the case of the toner particles including an external additive, each toner particle includes the external additive and a toner mother particle having a toner core and a shell layer. The external additive adheres to a surface of the toner mother particle. The external additive may be omitted if not required. In the toner including no external additive, the toner mother particles are equivalent to the toner particles.

The following describes the toner according to the present embodiment in detail with reference to the accompanying drawings as appropriate.

[Structure of Toner Particles]

The following describes a structure of the toner particles included in the toner according to the present embodiment with reference to FIG. 1. FIG. 1 is a diagram illustrating an example of a cross-sectional structure of a toner particle included in the toner according to the present embodiment. In order to facilitate explanation, a toner particle 10 illustrated in FIG. 1 will be described as a toner particle including no external additive.

The toner particle 10 illustrated in FIG. 1 includes a toner core 11 containing a binder resin and a shell layer 12 covering a surface of the toner core 11. The shell layer 12 contains a branched macromolecule. The branched macromolecule includes a repeating unit having an oxazoline group. The ratio ($r_B/r_L$) between $r_B$ of the branched macromolecule and $r_L$ of the corresponding linear macromolecule is no greater than 0.80. In order to ensure low-temperature fixability of the toner more easily, the ratio ($r_B/r_L$) is preferably at least 0.60.

The shell layer 12 may further contain a component (for example, a charge control agent) other than the branched macromolecule. In order to obtain a toner having further improved heat-resistant preservability while ensuring low-temperature fixability of the toner, however, an amount of the branched macromolecule among all components of the shell layer 12 is preferably at least 80% by mass, more preferably at least 90% by mass, and particularly preferably 100% by mass.

In order to obtain a toner having further improved heat-resistant preservability while ensuring low-temperature fixability of the toner, the shell layer 12 preferably has a thickness of at least 1 nm and no greater than 400 nm. The thickness of the shell layer 12 can be measured by dying the toner particle 10 and analyzing a transmission electron microscope (TEM) image of a cross-section of the dyed toner particle 10 using commercially available image analysis software (for example, "WinROOF", product of Mitani Corporation). Note that if the thickness of the shell layer 12 is not uniform for a single toner particle 10, the thickness of the shell layer 12 is measured at each of four locations that are approximately evenly spaced and the arithmetic mean of the four measured values is determined to be an evaluation value (the thickness of the shell layer 12) for the toner particle 10. Specifically, the four measurement locations are determined by drawing two straight lines that intersect at right angles at approximately the center of the cross-section of the toner particle 10 and determining four locations at which the two straight lines and the shell layer 12 intersect to be the measurement locations.

In order to obtain a toner suitable for image formation, the toner core 11 preferably has a volume median diameter ($D_{50}$) of at least 4 μm and no greater than 9 μm.

An example of the toner particles included in the toner according to the present embodiment has been described above with reference to FIG. 1. However, the present disclosure is not limited as such. For example, the toner particles included in the toner according to the present disclosure may include an external additive (not shown). For example, toner particles included in the toner according to the present disclosure may each include the toner particle 10 illustrated in FIG. 1 as a toner mother particle and have an external additive adhering to a surface of the toner mother particle.

[Components of Toner Particles]

The following describes components of the toner particles included in the toner according to the present embodiment.

(Binder Resin)

In order to obtain a toner having excellent low-temperature fixability, the toner cores preferably contain a thermoplastic resin as a binder resin. More preferably, the thermoplastic resin contained in the toner cores accounts for at least 85% by mass of a total mass of the binder resin. Examples of thermoplastic resins that can be used include styrene-based resins, acrylic acid ester-based resins, olefin-based resins (specific examples include polyethylene resins and polypropylene resins), vinyl resins (specific examples include vinyl chloride resins, polyvinyl alcohol, vinyl ether resins, and N-vinyl resins), polyester resins, polyamide resins, and urethane resins. Furthermore, copolymers of the resins listed above, that is, copolymers obtained through incorporation of a repeating unit into any of the resins listed above (specific examples include styrene-acrylic acid ester-based resins and styrene-butadiene-based resins) may be used as the binder resin.

A thermoplastic resin can be obtained through addition polymerization, copolymerization, or polycondensation of at least one thermoplastic monomer. Note that the thermoplastic monomer means a monomer that forms a thermoplastic resin through homopolymerization (specific examples include acrylic acid ester-based monomers and styrene-based monomers) or a monomer that forms a thermoplastic resin through polycondensation (for example, a combination of a polyhydric alcohol and a polycarboxylic acid that form a polyester resin through polycondensation).

In order to obtain a toner having excellent low-temperature fixability, the toner cores preferably contain a polyester resin as the binder resin. In order that the polyester resin contained as the binder resin is highly reactive with an oxazoline group in a repeating unit (1-1) described below, the polyester resin preferably has an acid value of at least 5 mgKOH/g, and more preferably an acid value of at least 5 mgKOH/g and no greater than 27 mgKOH/g.

Preferably, the polyester resin is a resin mixture of a crystalline polyester resin and a non-crystalline polyester resin. As a result of the toner cores containing a crystalline polyester resin and a non-crystalline polyester resin as the binder resin, it is possible to obtain a toner having excellent low-temperature fixability while ensuring high dispersibility of the internal additive. In such a case, no particular limitations are placed on a mixing ratio between the crystalline polyester resin and the non-crystalline polyester resin. For example, at least 1 part by mass and no greater than 30 parts by mass of the crystalline polyester resin can be mixed relative to 100 parts by mass of the non-crystalline polyester resin.

In order that the toner is suitably sharp-melting, the toner cores preferably contain a crystalline polyester resin having a crystallinity index of at least 0.90 and no greater than 1.20 as the binder resin. The crystallinity index of the crystalline polyester resin can be adjusted by changing materials for synthesizing the crystalline polyester resin or amounts of use (blend ratio) of the materials. Note that the crystallinity index of a resin is equivalent to a ratio (Tm/Mp) of the softening point (Tm, unit: ° C.) of the resin to the melting point (Mp, unit: ° C.) of the resin. Mp of a non-crystalline polyester resin is often indeterminable. That is, a resin may be measured using a differential scanning calorimeter to result in a heat absorption curve on which an endothermic peak cannot be clearly determined. Such a resin can be determined to be a non-crystalline polyester resin.

A polyester resin is obtained through polycondensation of at least one polyhydric alcohol and at least one polycarboxylic acid. Examples of alcohols that can be used for synthesis of the polyester resin include dihydric alcohols (specific examples include aliphatic diols and bisphenols) and tri- or higher-hydric alcohols listed below. Examples of carboxylic acids that can be used for synthesis of the polyester resin include dibasic carboxylic acids and tri- or higher-basic carboxylic acids listed below. Note that a derivative of a polycarboxylic acid that can form an ester bond through polycondensation, such as a polycarboxylic acid anhydride or a polycarboxylic acid halide, may be used instead of a polycarboxylic acid.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- and higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

In a composition in which the binder resin contains a polyester resin, the binder resin may be composed only of the polyester resin, or the binder resin may contain the polyester resin and another resin. In a composition in which the binder resin contains a crystalline polyester resin and a non-crystalline polyester resin, the binder resin preferably further contains a styrene-acrylic acid-based resin. The styrene-acrylic acid-based resin is a copolymer of at least one styrene-based monomer and at least one acrylic acid-based monomer. As a result of the binder resin containing a styrene-acrylic acid-based resin, it is possible to obtain a toner having excellent charge stability.

Examples of styrene-based monomers that can be used for synthesis of the styrene-acrylic acid-based resin include styrene, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

Examples of acrylic acid-based monomers that can be used for synthesis of the styrene-acrylic acid-based resin include (meth)acrylic acid, methyl (meth)acrylate, ethyl (meth)acrylate, n-propyl (meth)acrylate, iso-propyl (meth) acrylate, n-butyl (meth)acrylate, isobutyl (meth)acrylate, t-butyl (meth)acrylate, n-octyl (meth)acrylate, 2-ethylhexyl (meth)acrylate, stearyl (meth)acrylate, lauryl (meth)acrylate, and phenyl (meth)acrylate.

(Colorant)

The toner cores may contain a colorant. The colorant can be a commonly known pigment or dye that matches the color of the toner. In order to form high-quality images using the toner, the colorant is preferably contained in an amount of at least 1 part by mass and no greater than 20 parts by mass relative to 100 parts by mass of the binder resin.

The toner cores may contain a black colorant. The black colorant is for example carbon black. A colorant that is adjusted to a black color using a yellow colorant, a magenta colorant, and a cyan colorant can be used as a black colorant.

The toner cores may contain a non-black colorant. The non-black colorant is for example a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example at least one compound selected from the group consisting of copper phthalocyanine compounds, anthraquinone compounds, and basic dye lake compounds. Examples of cyan colorants that can be used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may contain a releasing agent. The releasing agent is for example used to obtain a toner having excellent offset resistance. In order to obtain a toner having excellent offset resistance, the releasing agent is preferably contained in an amount of at least 1 part by mass and no greater than 20 parts by mass relative to 100 parts by mass of the binder resin.

Examples of releasing agents that can be used include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of ester waxes that can be used include natural ester waxes (specific examples include carnauba wax and rice wax) and synthetic ester waxes. According to the present embodiment, one releasing agent may be used independently, or two or more releasing agents may be used in combination.

A compatibilizer may be added to the toner cores in order to improve compatibility between the binder resin and the releasing agent.

(Charge Control Agent)

The toner cores may contain a charge control agent. The charge control agent is for example used in order to improve charge stability and a charge rise characteristic of the toner. The charge rise characteristic of the toner is an indicator as to whether the toner can be charged to a specific charge level in a short period of time.

The cationic strength of the toner cores can be increased through the toner cores containing a positively chargeable charge control agent. The anionic strength of the toner cores can be increased through the toner cores containing a negatively chargeable charge control agent.

Examples of positively chargeable charge control agents that can be used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amines; alkylamides; quaternary ammonium salts such as benzyldecylhexylmethyl ammonium chloride, decyltrimethyl ammonium chloride, 2-(methacryloyloxy)ethyltrimethylammonium chloride, and dimethylaminopropyl acrylamide methyl chloride quaternary salt; and quaternary ammonium cation group-containing resins. One of the charge control agents listed above may be used independently, or two or more of the charge control agents listed above may be used in combination.

Examples of negatively chargeable charge control agents that can be used include organic metal complexes, which are chelate compounds. Examples of preferable organic metal complexes include metal acetylacetonate complex, salicylic acid-based metal complex, and salts thereof.

In order to obtain a toner having excellent charge stability, the charge control agent is preferably contained in an amount of at least 0.1 parts by mass and no greater than 20 parts by mass relative to 100 parts by mass of the binder resin.

(Magnetic Powder)

The toner cores may contain a magnetic powder. Examples of materials of the magnetic powder that can be used include ferromagnetic metals (specific examples include iron, cobalt, and nickel) and alloys thereof, ferromagnetic metal oxides (specific examples include ferrite, magnetite, and chromium dioxide), and materials subjected to ferromagnetization (specific examples include carbon materials made ferromagnetic through thermal treatment). According to the present embodiment, one magnetic powder may be used independently, or two or more magnetic powders may be used in combination.

(Shell Layer)

The shell layers contain a branched macromolecule. The branched macromolecule includes a repeating unit having an oxazoline group. The ratio $r_B/r_L$ between $r_B$ of the branched macromolecule and $r_L$ of the corresponding linear macromolecule (also referred to below simply as "$r_B/r_L$") is no greater than 0.80. In order to obtain a toner having further improved heat-resistant preservability while ensuring low-temperature fixability of the toner, $r_B$ of the branched macromolecule is preferably at least 20 nm and no greater than 30 nm, and more preferably at least 23 nm and no greater than 27 nm.

In a composition in which the binder resin in the toner cores contains a polyester resin, the repeating unit having an oxazoline group in the branched macromolecule is preferably a repeating unit represented by formula (1-1) shown below (referred to below as a repeating unit (1-1)) in order to uniformly form the shell layers on the surfaces of the toner cores. The macromolecule including the repeating unit (1-1) is also referred to below as an oxazoline group-containing macromolecule.

(1-1)

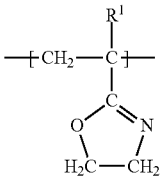

In formula (1-1), $R^1$ represents a hydrogen atom or an alkyl group optionally substituted with a phenyl group. Examples of alkyl groups that may be represented by $R^1$ include a methyl group, an ethyl group, and an isopropyl group. Examples of preferable $R^1$ include a hydrogen atom, a methyl group, an ethyl group, and an isopropyl group.

The repeating unit (1-1) has a non-ring-opened oxazoline group. The non-ring-opened oxazoline group has a ring structure and has strong positive chargeability. The non-ring-opened oxazoline group is reactive with a carboxy group, an aromatic sulfanyl group, and an aromatic hydroxy group. During the shell layer formation, for example, a reaction between the repeating unit (1-1) and a carboxy group in the polyester resin in the toner cores occurs to cause ring-opening of the oxazoline group, and thus an amide bond and an ester bond are formed as illustrated in formula (1-2) shown below. Formation of such bonds ensures strong bonding between the toner cores and the shell layers, and inhibits detachment of the shell layers from the toner cores. $R^1$ in formula (1-2) shown below is the same as defined for $R^1$ in formula (1-1). An asterisk in formula (1-2) shown below represents a site that is bonded to an atom in the toner cores.

(1-2)

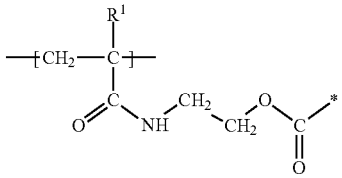

In order to inhibit detachment of the shell layers from the toner cores while improving positive chargeability of the toner, the branched macromolecule contained in the shell layers is preferably a vinyl resin including the repeating unit (1-1) and a repeating unit represented by formula (1-2) (referred to below as a repeating unit (1-2)). The vinyl resin including the repeating unit (1-1) and the repeating unit (1-2) is also referred to below as a specific vinyl resin. The strength of positive chargeability of the specific vinyl resin (that is, positive chargeability of the toner) tends to increase with an increase in a proportion (mole ratio) of the repeating unit (1-1) in the specific vinyl resin. The strength of bonding between the toner cores and the shell layers tends to increase with an increase in a proportion (mole ratio) of the repeating unit (1-2) in the specific vinyl resin. In order to inhibit detachment of the shell layers from the toner cores while improving positive chargeability of the toner, the shell layers are preferably composed only of the specific vinyl resin. The mole ratio between the repeating unit (1-1) and the repeating unit (1-2) in the specific vinyl resin can for example be adjusted by changing at least one of the acid value of the binder resin in the toner cores and an amount of a ring-opening agent (for example, an aqueous acetic acid solution) that is used for the shell layer formation.

Formation of the repeating unit (1-2) through ring-opening of the oxazoline group during the shell layer formation can for example be confirmed by a method described below. First, a specific amount of toner particles (a sample) are dissolved in a solvent. The resultant solution is placed in a test tube for nuclear magnetic resonance (NMR) measurement, and a $^1$H-NMR spectrum is measured using an NMR apparatus. In the $^1$H-NMR spectrum, a triplet signal derived from a secondary amide appears around a chemical shift 8 of 6.5. The presence of a triplet signal around a chemical shift 8 of 6.5 in the measured $^1$H-NMR spectrum therefore indicates formation of the repeating unit (1-2) through ring-opening of the oxazoline group during the shell layer formation. Measurement conditions for the $^1$H-NMR spectrum are for example as follows.

(Example of Measurement Conditions for $^1$H-NMR Spectrum)

NMR apparatus: Fourier transform nuclear magnetic resonance (FT-NMR) apparatus ("JNM-AL400", product of JEOL Ltd.)

Test tube for NMR measurement: 5-mm test tube

Solvent: Deuterated chloroform (1 mL)

Temperature of sample: 20° C.

Mass of sample: 20 mg

Number of times of accumulation: 128 times

Internal standard substance of chemical shift: Tetramethylsilane (TMS)

Examples of monomers that can be used for formation of the specific vinyl resin include a compound represented by formula (1) shown below (also referred to below as a compound (1)). The compound (1) forms the repeating unit (1-1) through addition polymerization. $R^1$ in formula (1) shown below is the same as defined for $R^1$ in formula (1-1).

(1)

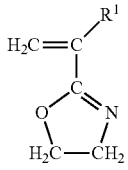

The specific vinyl resin may be a copolymer obtained through copolymerization of the compound (1) with an additional vinyl compound. A vinyl compound refers to a compound having a vinyl group ($CH_2$—CH—) or a substituted vinyl group in which hydrogen is replaced (specific examples include ethylene, propylene, butadiene, vinyl chloride, (meth)acrylic acid, methyl (meth)acrylate, (meth) acrylonitrile, and styrene). The vinyl compound can be formed into a polymer (resin) by addition polymerization through carbon-to-carbon double bonds "C═C" in the vinyl group or the substituted vinyl group.

The additional vinyl compound is preferably at least one vinyl compound selected from the group consisting of alkyl acrylate-based monomers and styrene-based monomers.

Examples of alkyl acrylate-based monomers that can be used include a compound represented by formula (2) shown below (also referred to below as a compound (2)) and a compound represented by formula (3) shown below (also referred to below as a compound (3)).

(2)

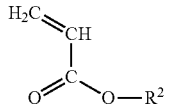

In formula (2), $R^2$ represents an alkyl group optionally substituted with a substituent. Examples of alkyl groups that may be represented by $R^2$ include a methyl group, an ethyl group, an n-propyl group, an isopropyl group, an n-butyl group, an isobutyl group, and a 2-ethylhexyl group. In a situation in which $R^2$ represents an alkyl group substituted with a substituent, the substituent is for example a hydroxy group. Examples of preferable $R^2$ include a methyl group, an ethyl group, an n-propyl group, an isopropyl group, an n-butyl group, an isobutyl group, a 2-ethylhexyl group, a hydroxyethyl group (for example, a 2-hydroxyethyl group), a hydroxypropyl group, and a hydroxybutyl group.

(3)

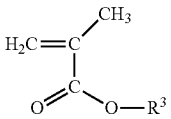

In formula (3), $R^3$ represents an alkyl group optionally substituted with a substituent. Examples of alkyl groups that may be represented by $R^3$ include a methyl group, an ethyl group, an n-propyl group, an isopropyl group, an n-butyl group, an isobutyl group, and a 2-ethylhexyl group. In a situation in which $R^3$ represents an alkyl group substituted with a substituent, the substituent is for example a hydroxy group. Examples of preferable $R^3$ include a methyl group, an ethyl group, an n-propyl group, an isopropyl group, an n-butyl group, an isobutyl group, a 2-ethylhexyl group, a hydroxyethyl group (for example, a 2-hydroxyethyl group), a hydroxypropyl group, and a hydroxybutyl group.

In order to obtain a toner having further improved heat-resistant preservability while ensuring low-temperature fixability of the toner, the branched macromolecule in the shell layers is preferably a copolymer obtained through copolymerization of the compound (1) with at least one of the compounds (2) and (3).

In a composition in which the binder resin in the toner cores contains a polyester resin including a repeating unit derived from terephthalic acid and the repeating unit having an oxazoline group in the branched macromolecule is the repeating unit (1-1), the terephthalic acid is preferably contained in an amount of no greater than 100 mass ppm as measured under conditions described below. That is, 2 g of the toner according to the present embodiment and 50 g of distilled water at a temperature of 50° C. are mixed under stirring, and the resultant mixture is centrifuged to collect supernatant. The amount of terephthalic acid contained in the thus collected supernatant (also referred to below as a terephthalic acid content) is preferably no greater than 100 mass ppm. The terephthalic acid in the supernatant is a material remaining unreacted in synthesis of the polyester resin (a residual monomer). As a result of the terephthalic acid content being no greater than 100 mass ppm, the binder resin can be prevented from bleeding out of the toner cores (particularly, the low-molecular component of the binder resin can be prevented from bleeding out of the toner cores), making it possible to obtain a toner having further improved heat-resistant preservability. In order to reduce the manufacturing cost of the toner, the terephthalic acid content is preferably at least 10 mass ppm. In a composition in which the binder resin in the toner cores contains a plurality of polyester resins, the above-described "polyester resin having a repeating unit derived from terephthalic acid" is at least one of the plurality of polyester resins.

Preferably, the terephthalic acid content is measured by high-performance liquid chromatography (also referred to below as HPLC). When the terephthalic acid content is measured by HPLC, preferably, the supernatant is filtered (for example, through a filter having a pore size of 0.45 μm), and then the amount of the terephthalic acid contained in the resultant filtrate is measured by HPLC in order to prevent column clogging. Hereinafter, the terephthalic acid content is equivalent to the "amount of the terephthalic acid contained in the filtrate" when measured using the filtrate obtained by filtering the supernatant. The terephthalic acid content is equivalent to the "amount of terephthalic acid contained in the supernatant" when measured using the supernatant unfiltered. The terephthalic acid content is measured by HPLC according to the same method described below in association with Examples or a method conforming therewith.

In order to easily adjust $r_B/r_L$ to no greater than 0.80, the branched macromolecule in the shell layers preferably further includes a unit derived from a polymerization initiation group-containing compound described below (also referred to below as a specific polymerization initiation group-containing compound).

The specific polymerization initiation group-containing compound has three or more polymerization initiation groups in a molecule thereof which are all represented by formula (A) shown below. Each polymerization initiation group represented by formula (A) is also referred to below as a polymerization initiation group (A).

(A)

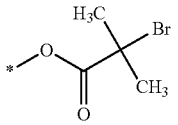

An asterisk in formula (A) represents a site bonded to a portion of the specific polymerization initiation group-containing compound, the portion not being a polymerization initiation group (A).

The polymerization initiation groups (A) are each a starting point of a reaction of polymerization (for example, radical polymerization) of monomers for forming the branched macromolecule in the presence of the specific polymerization initiation group-containing compound. That is, sites derived from the polymerization initiation groups (A) form branch points as a result of the polymerization of the monomers for forming the branched macromolecule in the presence of the specific polymerization initiation group-containing compound. Through the above, the branched macromolecule including the main chain (the linear chain including a repeating unit having an oxazoline group) bonded to the sites derived from the polymerization initiation groups (A) is obtained. The degree of branching of the resulting branched macromolecule tends to increase with an increase in the number of polymerization initiation groups (A) in a molecule of the specific polymerization initiation group-containing compound that is used. $r_B$ of the branched macromolecule and $r_B/r_L$ can be adjusted by changing at least one of the type of the specific polymerization initiation group-containing compound and the amount of the specific polymerization initiation group-containing compound relative to the total mass of the monomers.

In order to obtain a toner having further improved heat-resistant preservability while easily ensuring low-temperature fixability of the toner, the specific polymerization initiation group-containing compound is preferably a compound having at least three and no greater than six polymerization initiation groups (A) in a molecule thereof.

In order to obtain a toner having still further improved heat-resistant preservability while easily ensuring low-temperature fixability of the toner, the specific polymerization initiation group-containing compound is preferably a compound represented by formula (A-1), (A-2), or (A-3) shown below. $R^A$ in formulae (A-1), (A-2), and (A-3) represents the polymerization initiation group (A). The compounds represented by formulae (A-1), (A-2), and (A-3) are also referred to below as polymerization initiation group-containing compounds (A-1), (A-2), and (A-3), respectively.

(A-1)

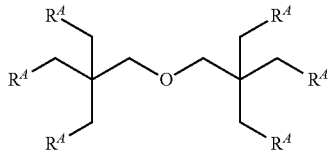

(A-2)

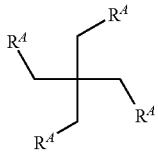

(A-3)

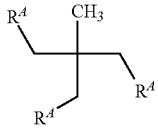

In order to obtain a toner having further improved heat-resistant preservability, the branched macromolecule in the shell layers is preferably a specific vinyl resin further including a unit derived from the polymerization initiation group-containing compound (A-1). In order to easily ensure low-temperature fixability of the toner, the branched macromolecule in the shell layers is preferably a specific vinyl resin further including a unit derived from the polymerization initiation group-containing compound (A-3).

Note that the radius of gyration of the specific vinyl resin serving as the branched macromolecule is a value obtained by measuring the vinyl resin before the amide bond and the ester bond are formed through a reaction with the toner cores (the vinyl resin including no repeating unit (1-2)). Likewise, the radius of gyration of the corresponding linear macromolecule is a value obtained by measuring a linear macromolecule including a main chain having the same structure as the main chain of the specific vinyl resin before the amide bond and the ester bond are formed through the reaction with the toner cores.

(External Additive)

The toner particles may further contain an external additive. The external additive is added for example by using the toner particles 10 illustrated in FIG. 1 as toner mother particles and stirring the toner mother particles (a powder) and external additive particles (a powder) together to cause the external additive particles to adhere to surfaces of the toner mother particles.

Examples of preferable external additive particles include resin particles and inorganic particles. Examples of preferable inorganic particles include silica particles and particles of a metal oxide (specific examples include alumina, titanium oxide, magnesium oxide, zinc oxide, strontium titanate, and barium titanate). According to the present embodiment, one type of external additive particles may be used independently, or two or more types of external additive particles may be used in combination.

In order to allow the external additive to sufficiently exhibit its function while inhibiting detachment of the external additive particles from the toner mother particles, an amount of the external additive (in a situation in which plural types of external additive particles are used, a total amount of the external additive particles) is preferably at least 0.5 parts by mass and no greater than 10 parts by mass relative to 100 parts by mass of the toner mother particles.

In order to obtain a toner having excellent fluidity, it is preferable to use inorganic particles (a powder) having a number average primary particle diameter of at least 5 nm and no greater than 500 nm as the external additive particles.

The external additive particles may be surface-treated particles. For example, in a situation in which silica particles are used as the external additive particles, either or both of hydrophobicity and positive chargeability may be imparted to surfaces of the silica particles using a surface treatment agent. Examples of surface treatment agents that can be used include coupling agents (specific examples include silane coupling agents, titanate coupling agents, and aluminate coupling agents), silazane compounds (specific examples include chain silazane compounds and cyclic silazane compounds), and silicone oils (specific examples include dimethylsilicone oil). Particularly preferably, the surface treatment agent is a silane coupling agent or a silazane compound. Examples of preferable silane coupling agents include silane compounds (specific examples include methyltrimethoxysilane and aminosilane). Examples of preferable silazane compounds include hexamethyldisilazane (HMDS). When a surface of a silica base (untreated silica particles) is treated with the surface treatment agent, some or all of a large number of hydroxy groups (—OH) present in the surface of the silica base are replaced by functional groups derived from the surface treatment agent. As a result, silica particles having the functional groups derived from the surface treatment agent (specifically, functional groups that are more hydrophobic and/or more readily positively chargeable than the hydroxy groups) in surfaces thereof are obtained.

<Toner Production Method>

The following describes a preferable production method of the toner according to the embodiment described above. Elements that have been already described in the explanation of the toner according to the above embodiment will not be redundantly described below.

[Toner Core Preparation]

First, the toner cores are prepared by an aggregation method or a pulverization method.

The aggregation method for example includes an aggregation process and a coalescing process. In the aggregation process, fine particles of toner core components are caused to aggregate in an aqueous medium to form aggregated particles. In the coalescing process, the components in the aggregated particles are caused to coalesce in the aqueous medium to form toner cores.

The following describes the pulverization method. The toner cores can be prepared relatively easily at a low manufacturing cost by the pulverization method. Toner core preparation by the pulverization method for example includes a melt-kneading process and a pulverizing process. Toner core preparation by the pulverization method may further include a mixing process before the melt-kneading process. Toner core preparation by the pulverization method may further include at least one of a finely pulverizing process and a classification process after the pulverizing process.

In the mixing process, for example, a binder resin and an optional internal additive are mixed to obtain a mixture. In the melt-kneading process, a toner material is melt-kneaded to obtain a melt-kneaded product. The toner material is for example the mixture obtained through the mixing process. In the pulverizing process, the melt-kneaded product obtained as described above is cooled to for example room temperature (25° C.) and pulverized to obtain a pulverized product. In a situation in which the size of the pulverized product obtained through the pulverizing process needs to be reduced, a process of further pulverizing the pulverized product (the finely pulverizing process) may be performed. In a situation in which the size of the pulverized product needs to be uniform, a process of classifying the pulverized product (the classification process) may be performed. The pulverized product obtained through the above-described processes is used as the toner cores.

[Shell Layer Formation]

Next, the toner cores obtained as described above, a material for forming the shell layers (a shell material), and water (for example, ion exchanged water) are placed in a vessel. Subsequently, the internal temperature of the vessel is increased up to a specific temperature (for example, a temperature of at least 60° C. and no greater than 70° C.) while the vessel contents are stirred. The shell material is for example an aqueous solution of the branched macromolecule including the repeating unit (1-1) and the unit derived from the specific polymerization initiation group-containing compound (also referred to below as an aqueous branched macromolecule solution). The following describes an example in which the toner cores contain a polyester resin as the binder resin and the shell material for forming the shell layers is the aqueous branched macromolecule solution.

The internal temperature of the vessel is increased at a heating rate of for example at least 0.4° C./minute and no greater than 0.6° C./minute. A ring-opening agent (for example, an aqueous acetic acid solution) for promoting ring-opening of the oxazoline group in the shell material may be added during the heating. Alternatively or additionally, the shell material may be added during the heating.

Once the internal temperature of the vessel reaches the specific temperature, the vessel contents are stirred while the specific temperature is kept for a predetermined period of time (for example, 30 minutes to 90 minutes). As a result, some of oxazoline groups present in the molecules of the branched macromolecule react with carboxy groups present in the surfaces of the toner cores (carboxy groups in the polyester resin). Through the reaction, the oxazoline groups undergo ring-opening, and amide bonds and ester bonds are formed. As a result, the shell layers covering the surfaces of the toner cores are formed, and the shell layers are fixed to the surfaces of the toner cores. Next, the vessel contents are cooled to room temperature (25° C.) to obtain a toner mother particle-containing dispersion. The shell layer coverage ratio and the amount of the shell layers can be adjusted by changing at least one of the branched macromolecule concentration (solid concentration) of the aqueous branched macromolecule solution and the amount of the aqueous branched macromolecule solution that is used. In a composition in which the binder resin of the toner cores contains a polyester resin including a repeating unit derived from terephthalic acid, the terephthalic acid content decreases with an increase in the shell layer coverage ratio.

[Washing and Drying]

The toner mother particles in the dispersion obtained as described above are washed with ion exchanged water, and then the toner mother particles are dried using for example a continuous type surface modifier. Through the above, a powder of the toner mother particles is obtained.

[External Additive Addition]

Thereafter, as necessary, an external additive may be caused to adhere to the surfaces of the toner mother particles obtained as described above by mixing the toner mother particles and the external additive using a mixer (for example, an FM mixer, product of Nippon Coke & Engineering Co., Ltd.). Note that the toner mother particles may be used as toner particles without undergoing external additive addition. Through the above, the toner (a powder of toner particles) according to the embodiment described above is obtained.

EXAMPLES

The following describes Examples of the present disclosure and Comparative Examples.

<Synthesis of Binder Resin>

[Synthesis of Non-Crystalline Polyester Resin R-1]

A four-necked flask having a capacity of 10 L and equipped with a thermometer (a thermocouple), a drainage tube, a nitrogen inlet tube, and a stirrer was charged with 370 g of bisphenol A propylene oxide adduct (average number of moles of propylene oxide added: 2 mol), 3,059 g of bisphenol A ethylene oxide adduct (average number of moles of ethylene oxide added: 2 mol), 1,194 g of terephthalic acid, 286 g of fumaric acid, 10 g of tin(II) 2-ethylhexanoate, and 2 g of gallic acid. Subsequently, the flask contents were caused to react under a nitrogen atmosphere at 230° C. until a reaction completion rate reached 90% by mass. The reaction completion rate was calculated in accordance with the following expression: "reaction completion rate=100× actual amount of water generated by reaction/theoretical amount of water generated by reaction". Subsequently, the flask contents were caused to react under a reduced pressure atmosphere (pressure: 8.3 kPa) at 230° C. until a reaction product (a resin) having a Tm of 89° C. was obtained. Thus, a non-crystalline polyester resin R-1 (acid value: 7 mgKOH/g) was obtained. The non-crystalline polyester resin R-1 had a Tg of 50° C.

[Synthesis of Non-Crystalline Polyester Resin R-2]

A four-necked flask having a capacity of 10 L and equipped with a thermometer (a thermocouple), a drainage tube, a nitrogen inlet tube, and a stirrer was charged with 1,286 g of bisphenol A propylene oxide adduct (average number of moles of propylene oxide added: 2 mol), 2,218 g of bisphenol A ethylene oxide adduct (average number of moles of ethylene oxide added: 2 mol), 1,603 g of terephthalic acid, 10 g of tin(II) 2-ethylhexanoate, and 2 g of gallic acid. Subsequently, the flask contents were caused to react under a nitrogen atmosphere at 230° C. until the reaction completion rate represented by the above expression reached 90% by mass. Subsequently, the flask contents were caused to react under a reduced pressure atmosphere (pressure: 8.3 kPa) at 230° C. until a reaction product (a resin) having a Tm of 111° C. was obtained. Thus, a non-crystalline polyester resin R-2 (acid value: 27 mgKOH/g) was obtained. The non-crystalline polyester resin R-2 had a Tg of 69° C.

[Synthesis of Non-Crystalline Polyester Resin R-3]

A four-necked flask having a capacity of 10 L and equipped with a thermometer (a thermocouple), a drainage tube, a nitrogen inlet tube, and a stirrer was charged with 4,907 g of bisphenol A propylene oxide adduct (average number of moles of propylene oxide added: 2 mol), 1,942 g of bisphenol A ethylene oxide adduct (average number of moles of ethylene oxide added: 2 mol), 757 g of fumaric acid, 2,078 g of n-dodecylsuccinic acid anhydride, 30 g of tin(II) 2-ethylhexanoate, and 2 g of gallic acid. Subsequently, the flask contents were caused to react under a nitrogen atmosphere at 230° C. until the reaction completion rate represented by the above expression reached 90% by mass. The flask content were then caused to react for 1 hour under a reduced pressure atmosphere (pressure: 8.3 kPa) at 230° C. Subsequently, 548 g of trimellitic anhydride was added into the flask, and the flask contents were caused to react under a reduced pressure atmosphere (pressure: 8.3 kPa) at 220° C. until a reaction product (a resin) having a Tm of 127° C. was obtained. Thus, a non-crystalline polyester resin R-3 (acid value: 14 mgKOH/g) was obtained. The non-crystalline polyester resin R-3 had a Tg of 51° C.

[Synthesis of Composite Resin of Crystalline Polyester Resin and Styrene-Acrylic Acid Copolymer]

A four-necked flask having a capacity of 10 L and equipped with a thermometer (a thermocouple), a drainage tube, a nitrogen inlet tube, and a stirrer was charged with 2,643 g of 1,6-hexanediol, 864 g of 1,4-butanediol, and 2,945 g of succinic acid. Subsequently, the internal temperature of the flask was increased up to 160° C. to melt the flask contents. Next, a liquid mixture of 1,831 g of styrene, 161 g of acrylic acid, and 110 g of dicumyl peroxide was dripped into the flask over 1 hour using a dripping funnel. Next, the flask contents were caused to react for 1 hour under a nitrogen atmosphere at 170° C., and then unreacted styrene and unreacted acrylic acid were removed over 1 hour under a reduced pressure atmosphere (pressure: 8.3 kPa) at 200° C. Subsequently, the internal pressure of the flask was restored to the atmospheric pressure, and 40 g of tin(II) 2-ethylhexanoate and 3 g of gallic acid were added into the flask. Thereafter, the flask contents were caused to react under a nitrogen atmosphere at 210° C. for 8 hours. Next, the flask contents were caused to react for 1 hour under a reduced pressure atmosphere (pressure: 8.3 kPa) at 210° C. to yield a composite resin of a crystalline polyester resin and a styrene-acrylic acid copolymer (referred to below as a composite resin R-4). The composite resin R-4 had an acid value of 5 mgKOH/g, a Tm of 92° C., an Mp of 96° C., and a crystallinity index (Tm/Mp) of 0.96.

<Preparation of Aqueous Macromolecule Solution>

[Preparation of Aqueous Macromolecule Solution PL-1]

A four-necked flask having a capacity of 300 mL and equipped with a thermometer (a thermocouple), a reflux condenser, a nitrogen inlet tube, and a stirrer was set in an oil bath. The flask was then charged with 120 g of ion exchanged water, 0.5 g of sodium persulfate, 11.6 g of 2-vinyl-2-oxazoline as a monomer, and 1.1 g of 2-hydroxyethyl acrylate as a monomer. Next, the internal temperature of the flask was increased up to 50° C. under a flow of nitrogen, and then the flask contents were stirred at a rotational speed of 200 rpm for 10 hours while the internal temperature of the flask was kept at 50° C. 1° C. to cause a polymerization reaction of the monomers. Next, the flask contents were cooled to 25° C. to yield an aqueous macromolecule solution PL-1 containing an oxazoline group-containing linear macromolecule (solid concentration: 10% by mass).

[Preparation of Aqueous Macromolecule Solution PL-2]

An aqueous macromolecule solution PL-2 containing an oxazoline group-containing linear macromolecule (solid concentration: 10% by mass) was obtained according to the same method as in the preparation of the aqueous macromolecule solution PL-1 in all aspects other than that the monomers that were caused to react were changed to 11.6 g of 2-vinyl-2-oxazoline and 0.9 g of ethyl acrylate.

[Preparation of Aqueous Macromolecule Solution PL-3]

An aqueous macromolecule solution PL-3 containing an oxazoline group-containing linear macromolecule (solid concentration: 10% by mass) was obtained according to the same method as in the preparation of the aqueous macromolecule solution PL-1 in all aspects other than that the monomers that were caused to react were changed to 11.6 g of 2-vinyl-2-oxazoline and 0.8 g of methyl acrylate.

[Preparation of Aqueous Macromolecule Solution PB-1]

A four-necked flask having a capacity of 300 mL and equipped with a thermometer (a thermocouple), a reflux condenser, a nitrogen inlet tube, and a stirrer was charged with 381 mg of the polymerization initiation group-containing compound (A-1), 0.2 g of copper(I) bromide as a catalyst, and 120 mL of degassed ion exchanged water. Next, a reduced pressure nitrogen atmosphere was established in the flask, and the flask was charged with 11.6 g of 2-vinyl-2-oxazoline as a monomer and 1.1 g of 2-hydroxyethyl acrylate as a monomer. Next, in order to promote catalyst activity of the copper(I) bromide, 2 g of a degassed aqueous N,N,N',N'',N''-pentamethyldiethylenetriamine (PMDETA) solution (concentration: 10% by mass) was added into the flask. Thereafter, the flask contents were stirred at a rotational speed of 200 rpm for 15 minutes. Next, the flask was set up in an oil bath, and the flask contents were stirred at a rotational speed of 200 rpm for 24 hours while the internal temperature of the flask was kept at 70° C. to cause a polymerization reaction of the monomers. Next, the flask contents were exposed to air to deactivate the catalyst and terminate the reaction. Subsequently, the flask contents were cooled to 25° C. to yield an aqueous macromolecule solution PB-1 containing an oxazoline group-containing branched macromolecule (solid concentration: 10% by mass).

[Preparation of Aqueous Macromolecule Solution PB-2]

An aqueous macromolecule solution PB-2 containing an oxazoline group-containing branched macromolecule (solid concentration: 10% by mass) was obtained according to the same method as in the preparation of the aqueous macromolecule solution PB-1 in all aspects other than that 243 mg of the polymerization initiation group-containing compound (A-2) was used instead of 381 mg of the polymerization initiation group-containing compound (A-1).

[Preparation of Aqueous Macromolecule Solution PB-3]

An aqueous macromolecule solution PB-3 containing an oxazoline group-containing branched macromolecule (solid concentration: 10% by mass) was obtained according to the same method as in the preparation of the aqueous macromolecule solution PB-1 in all aspects other than that 188 mg of the polymerization initiation group-containing compound (A-3) was used instead of 381 mg of the polymerization initiation group-containing compound (A-1).

[Preparation of Aqueous Macromolecule Solution PB-4]

An aqueous macromolecule solution PB-4 containing an oxazoline group-containing branched macromolecule (solid concentration: 10% by mass) was obtained according to the same method as in the preparation of the aqueous macromolecule solution PB-1 in all aspects other than that 119 mg of a polymerization initiation group-containing compound represented by formula (X-1) shown below was used instead of 381 mg of the polymerization initiation group-containing compound (A-1).

(X-1)

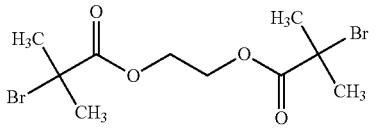

[Preparation of Aqueous Macromolecule Solution PB-5]

An aqueous macromolecule solution PB-5 containing an oxazoline group-containing branched macromolecule (solid concentration: 10% by mass) was obtained according to the same method as in the preparation of the aqueous macromolecule solution PB-1 in all aspects other than that 70 mg of a polymerization initiation group-containing compound represented by formula (X-2) shown below was used instead of 381 mg of the polymerization initiation group-containing compound (A-1).

(X-2)

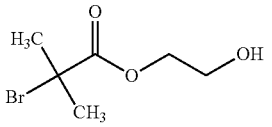

[Preparation of Aqueous Macromolecule Solution PB-6]

An aqueous macromolecule solution PB-6 containing an oxazoline group-containing branched macromolecule (solid concentration: 10% by mass) was obtained according to the same method as in the preparation of the aqueous macromolecule solution PB-1 in all aspects other than that the monomers that were caused to react were changed to 11.6 g of 2-vinyl-2-oxazoline and 0.9 g of ethyl acrylate.

[Preparation of Aqueous Macromolecule Solution PB-7]

An aqueous macromolecule solution PB-7 containing an oxazoline group-containing branched macromolecule (solid concentration: 10% by mass) was obtained according to the same method as in the preparation of the aqueous macromolecule solution PB-1 in all aspects other than that the monomers that were caused to react were changed to 11.6 g of 2-vinyl-2-oxazoline and 0.8 g of methyl acrylate.

<Measurement of Radius of Gyration of Oxazoline Group-Containing Macromolecule in Aqueous Macromolecule Solution>

With respect to each of the aqueous macromolecule solutions PB-1 to PB-7 obtained as described above, $r_B$ of the oxazoline group-containing macromolecule in the aqueous macromolecule solution was measured by GPC-MALLS. As a measuring device, a GPC-MALLS device was used which was equipped with a solvent pump ("SHODEX (registered Japanese trademark) DS-4", product of Showa Denko K.K.), a column ("PLgel 10 μm MIXED-B", product of Agilent Technologies Japan, Ltd.), and a multi-angle laser light scattering detector ("DAWN DSP-F", product of Wyatt Technology Corporation). The following describes the measurement method in detail. First, the measurement target aqueous macromolecule solution was diluted with purified water to prepare a sample solution having a resin (solid) concentration of 0.2% by mass. Next, the thus prepared sample solution was measured to obtain a double logarithmic plot with a horizontal axis representing absolute molecular weight and a vertical axis representing radius of gyration. The absolute molecular weight and the radius of gyration were determined under the following measurement conditions.

[Measurement Conditions]

Mobile phase: purified water (flow rate: 1.0 mL/minute)

Concentration of sample solution: 0.2% by mass (solvent: purified water)

Sample solution injection amount: 100 μL

Column temperature: 25° C.

Detector: differential refractometer and multi-angle laser light scattering detector Laser light wavelength of multi-angle laser light scattering detector: 633 nm (He—Ne)

Figure 2:
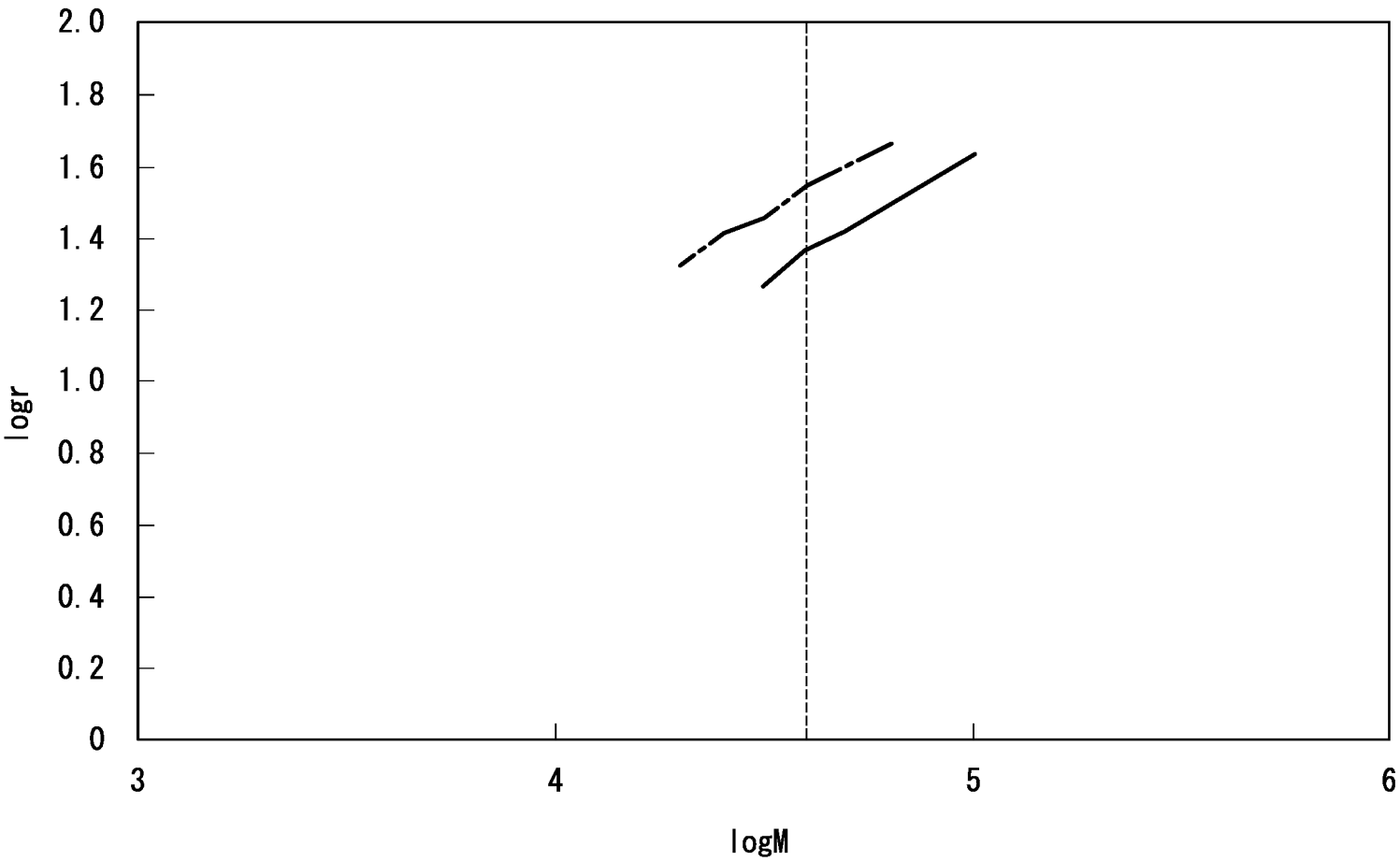
FIG. 2 is a plot showing an example of a relationship between the common logarithm of absolute molecular weight and the common logarithm of radius of gyration with respect to each of different macromolecules.

FIG. 2 shows an example of the double logarithmic plot. A solid line on the double logarithmic plot in FIG. 2 represents a relationship between the common logarithm (log M) of absolute molecular weight M and the common logarithm (log r) of radius of gyration r (unit: nm) with respect to the oxazoline group-containing macromolecule in the aqueous macromolecule solution PB-1 (also referred to below as a branched macromolecule PB-1). A dashed-dotted line on the double logarithmic plot in FIG. 2 represents a relationship between the common logarithm (log M) of absolute molecular weight M and the common logarithm (log r) of radius of gyration r (unit: nm) with respect to a linear macromolecule corresponding to the branched macromolecule PB-1. The linear macromolecule corresponding to the branched macromolecule PB-1 was the oxazoline group-containing macromolecule in the aqueous macromolecule solution PL-1 (also referred to below as a linear macromolecule PL-1). The measurement of the linear macromolecule PL-1 was performed under the same conditions as in the measurement of the branched macromolecule PB-1.

$r_B$ of the branched macromolecule PB-1 was determined as a common logarithm value of the radius of gyration at an intersection point between a dotted line (a line indicating an absolute molecular weight of 40,000) and the solid line in FIG. 2. $r_L$ of the linear macromolecule PL-1 was determined as a common logarithm value of the radius of gyration at an intersection point between the dotted line (the line indicating an absolute molecular weight of 40,000) and the dashed-dotted line in FIG. 2. Then, $r_B/r_L$ was calculated from the thus obtained $r_B$ and $r_L$. Results are shown in Table 1.

With respect to each of the aqueous macromolecule solutions PB-2 to PB-7, $r_B$ of the oxazoline group-containing macromolecule in the aqueous macromolecule solution was determined according to the same method as in the measurement of $r_B$ of the branched macromolecule PB-1 described above. Also, with respect to each of the aqueous macromolecule solutions PB-2 to PB-7, $r_L$ of the corresponding linear macromolecule (the oxazoline group-containing macromolecule in one of the aqueous macromolecule solutions PL-1 to PL-3) was determined according to the same method as in the measurement of $r_B$ of the branched macromolecule PB-1 described above. Then, $r_B/r_L$ was calculated with respect to the oxazoline group-containing macromolecules in the aqueous macromolecule solutions PB-2 to PB-7. Results are shown in Table 1.

TABLE 1

| Aqueous macromolecule solution | Aqueous macromolecule solution containing corresponding linear macromolecule | $r_B$ [nm] | $r_B/r_L$ |
|---|---|---|---|
| PB-1 | PL-1 | 23 | 0.65 |
| PB-2 | PL-1 | 25 | 0.72 |
| PB-3 | PL-1 | 27 | 0.77 |
| PB-4 | PL-1 | 34 | 0.97 |
| PB-5 | PL-1 | 34 | 0.97 |
| PB-6 | PL-2 | 25 | 0.66 |
| PB-7 | PL-3 | 25 | 0.67 |

<Preparation of Toner TA-1>

[Toner Core Preparation]

An FM mixer ("FM-20B", product of Nippon Coke & Engineering Co., Ltd.) was used to mix 300 g of the non-crystalline polyester resin R-1, 100 g of the non-crystalline polyester resin R-2, 600 g of the non-crystalline polyester resin R-3, 100 g of the composite resin R-4, 12 g of a first releasing agent ("CARNAUBA WAX No. 1", product of S. Kato & Co., ingredient: carnauba wax), 48 g of a second releasing agent ("NISSAN ELECTOL (registered Japanese trademark) WEP-3", product of NOF Corporation, ingredient: synthetic ester wax), and 144 g of a colorant ("COLORTEX (registered Japanese trademark) Blue B1021", product of SANYO COLOR WORKS, Ltd., ingredient: Phthalocyanine Blue) at a rotational speed of 2,400 rpm.

Subsequently, the resultant mixture was melt-kneaded using a twin-screw extruder ("PCM-30", product of Ikegai Corp.) under conditions of a material feeding rate of 5 kg/hour, a shaft rotational speed of 160 rpm, and a set temperature (cylinder temperature) of 100° C. Thereafter, the resultant kneaded product was cooled. After the cooling, the kneaded product was coarsely pulverized using a pulverizer ("ROTOPLEX 16/8", product of former TOA MACHINERY MFG). Subsequently, the resultant coarsely pulverized product was finely pulverized using a jet mill ("Model-I Super Sonic Jet Mill", product of Nippon Pneumatic Mfg.). Subsequently, the resultant finely pulverized product was classified using a classifier ("ELBOW JET Type EJ-LABO", product of Nittetsu Mining Co., Ltd.). As a result, toner cores having a Tm of 90° C., a Tg of 49° C., and a volume median diameter ($D_{50}$) of 6.7 μm were obtained.

[Shell Layer Formation]

A three-necked flask having a capacity of 1 L and equipped with a thermometer and a stirring impeller was set up in a water bath, and 300 mL of ion exchanged water was added into the flask. Thereafter, the internal temperature of the flask was kept at 30° C. using the water bath. Subsequently, 15 g of the aqueous macromolecule solution PB-1 was added into the flask, and then the flask contents were stirred. Subsequently, 300 g of the toner cores obtained as described above were added into the flask, and the flask contents were stirred at a rotational speed of 200 rpm for 1 hour. Thereafter, 300 mL of ion exchanged water was added into the flask. Subsequently, the internal temperature of the flask was increased up to 68° C. at a rate of 0.5° C./minute while the flask contents were stirred at a rotational speed of 250 rpm. Subsequently the flask contents were kept at the same temperature (68° C.) for 1 hour under stirring at a rotational speed of 100 rpm. Shell layers covering surfaces of the toner cores were formed while the flask contents were kept at 68° C. The shell layers were formed from only the branched macromolecule PB-1. Next, the flask contents were cooled to room temperature (25° C.) to obtain a toner mother particle-containing dispersion.

[Washing]

The toner mother particle-containing dispersion obtained as described above was filtered using a Buchner funnel (solid-liquid separation) to collect a wet cake of the toner mother particles. The resultant wet cake of the toner mother particles was dispersed in ion exchanged water, and the resultant dispersion was filtered using a Buchner funnel. Furthermore, dispersion and filtering were repeated five times to wash the toner mother particles.

[Drying]

Subsequently, the washed toner mother particles were dispersed in a 50% by mass aqueous ethanol solution. As a result, a slurry of the toner mother particles was obtained. Subsequently, the toner mother particles in the slurry were dried using a continuous type surface modifier ("COATMIZER" (registered Japanese trademark)", product of Freund Corporation) under conditions of a hot air flow temperature of 45° C. and a blower flow rate of 2 $m^3$/minute.

[External Additive Addition]

An FM mixer (product of Nippon Coke & Engineering Co., Ltd.) having a capacity of 10 L was used to mix 100 parts by mass of the dried toner mother particles, 1.50 parts by mass of hydrophobic fumed silica particles ("AEROSIL (registered Japanese trademark) R972", product of Nippon Aerosil Co., Ltd., hydrophobing agent: dimethyldichlorosilane (DDS), number average primary particle diameter: 16 nm), and 1.00 part by mass of conductive titanium oxide particles ("EC-100", product of Titan Kogyo, Ltd., base: $TiO_2$ particles, coat layer: Sb-doped $SnO_2$ film, number average primary particle diameter: 0.35 μm) for 10 minutes to cause the external additives (the fumed silica particles and the conductive titanium oxide particles) to adhere to the surfaces of the toner mother particles. The hydrophobic fumed silica particles were broken up using a jet mill ("Model-I Super Sonic Jet Mill", product of Nippon Pneumatic Mfg.) before use. Sifting was performed on the resultant powder (a powder of the toner mother particles having the external additives adhering thereto) using a 200-mesh sieve (pore size: 75 μm). As a result, a positively chargeable toner TA-1 was obtained.

<Production of Toners TA-2 to TA-5 and TB-1 to TB-6>

The toners TA-2 to TA-5, TB-1, TB-2, and TB-5 were each produced according to the same method as in the production of the toner TA-1 in all aspects other than that the aqueous macromolecule solution as shown in Table 3 described below was used (added into the flask in an amount of 15 g) instead of the aqueous macromolecule solution PB-1. However, in each of the toners TB-1, TB-2, and TB-5, shell layers were not formed due to agglomeration of the macromolecule in the aqueous macromolecule solution during the shell layer formation. The toners TB-3, TB-4, and TB-6 were each produced according to the same method as in the production of the toner TA-1 in all aspects other than that the aqueous macromolecule solution as shown in Table 3 described below was used (added into the flask in an amount of 15 g) instead of the aqueous macromolecule solution PB-1, and 10 g of a 10% by mass aqueous solution of a nonionic surfactant ("EMULGEN (registered Japanese trademark) 120, product of Kao Corporation) was added into the flask at the same time as the addition of the aqueous macromolecule solution. The toners TA-2 to TA-5, TB-3, TB-4, and TB-6, in which the shell layers were formed, were all positively chargeable toners.

<Measurement of Coverage Ratio>

The shell layer coverage ratio of the toners TA-1 to TA-5 was measured according to a method described below. With respect to each of the toners TA-1 to TA-5, a sample (the toner) was dispersed in a visible light curing resin ("ARONIX (registered Japanese trademark) D-800", product of Toagosei Co., Ltd.), and then the resin was caused to cure through visible light irradiation to obtain a hardened material. Thereafter, the hardened material was cut at a cutting rate of 0.3 mm/second using an ultrathin piece forming knife ("SUMI KNIFE (registered Japanese trademark)", product of Sumitomo Electric Industries, Ltd., a diamond knife having a blade width of 2 mm and a blade tip angle of 45°) and an ultramicrotome ("EM UC6", product of Leica Microsystems) to form a flake sample having a thickness of 150 nm. The thus obtained flake sample was dyed through exposure to vapor of an aqueous ruthenium tetroxide solution on a copper mesh for 10 minutes. Subsequently, an image of a cross-section of the dyed flake sample was captured using a transmission electron microscope (TEM) ("H-7100FA", product of Hitachi High-Technologies Corporation).

The thus obtained TEM image (images of cross-sections of the toner particles) was analyzed using image analysis software ("WinROOF", product of Mitani Corporation). Specifically, in a TEM image of a toner particle, the shell layer coverage ratio was determined by measuring a percentage of an area covered with the shell layer out of the surface area of the toner core (an area defined by an outline representing a periphery of the toner core). The shell layer coverage ratio was measured with respect to 10 toner particles included in the sample (the toner), and the arithmetic mean of the 10 measured values was determined to be an evaluation value (the shell layer coverage ratio) of the sample (the toner).

The toners TA-1 to TA-5 each had a shell layer coverage ratio of at least 90% and no greater than 100%.

<Measurement of Terephthalic Acid Content>

Figure 3:
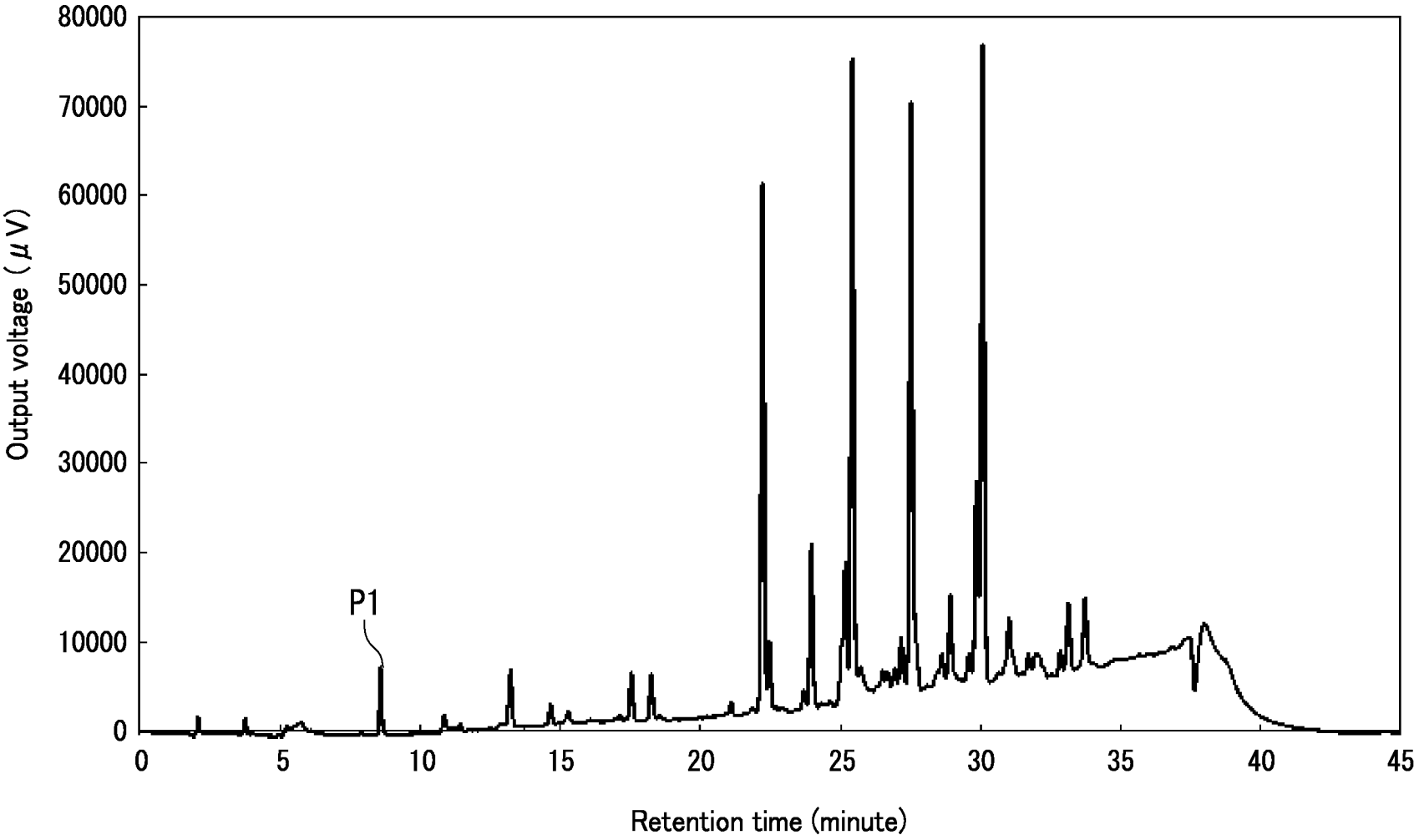
FIG. 3 is a chart showing an example of a result of analysis of the toner according to Example by high-performance liquid chromatography.

With respect to each of the toners TA-1 to TA-5 and TB-1 to TB-6, 2 g of the toner as an evaluation target and 50 g of distilled water at 50° C. were added into a 100-mL sample tube, and then the sample tube contents were mixed for 30 minutes under stirring at a rotational speed of 240 rpm using a stirrer. The mixing was performed while the temperature of the sample tube contents was kept at 50° C. Next, the sample tube contents were cooled to 30° C. Next, the sample tube contents were centrifuged at a rotational speed of 9,000 rpm for 15 minutes using a centrifuge adhesion measuring device ("NS-C100", product of Nano Seeds Corporation). Supernatant was collected through the centrifugation and filtered using a filter having a pore size of 0.45 μm. The resultant filtrate was used as a sample and analyzed by HPLC. Specifically, the sample was analyzed using the following analyzer under the following analysis conditions to obtain an HPLC chart. FIG. 3 shows an example of the HPLC chart. FIG. 3 shows a chart indicating a result of the analysis of the toner TA-1 by HPLC. Note that "output voltage" represented by the vertical axis in FIG. 3 indicates voltage output by a detector in an HPLC device used for the analysis.

[Analyzer]

An HPLC device ("LC-2010A HT", product of Shimadzu Corporation) was used as an analyzer. An HPLC column ("SHIM-PACK GWS C18", product of Shimadzu Corporation) was used.

[Analysis Conditions]

Measurement wavelength: 207 nm

Column temperature: 40° C.

Sample injection amount: 100 μL

Liquid A: aqueous phosphoric acid solution (concentration: 0.1% by mass)

Liquid B: acetonitrile

Total flow rate of liquids A and B: 1.0 mL/minute

Concentration gradient: as specified in Table 2

TABLE 2

| Time [minutes] | Liquid A | Liquid B |
|---|---|---|
| 0-35.00 | Decrease from 100% by volume to 20% by volume | Increase from 0% by volume to 80% by volume |
| 35.01-44.99 | 100% by volume | 0% by volume |
| 45.00 | 0% by volume | 0% by volume |

The amount of terephthalic acid contained in the sample (the terephthalic acid content) was determined from a peak area of a peak P1 (see FIG. 3) between a retention time of 8 minutes and a retention time of 9 minutes on the HPLC chart. Note that the terephthalic acid content was determined using a calibration curve based on standard substances. A peak P1 fraction of the HPLC chart shown in FIG. 3 was separated and subjected to qualitative analysis by gas chromatography-mass spectrometry (GC/MS) to confirm that the peak P1 fraction was terephthalic acid.

<Evaluation of Low-Temperature Fixability>

[Preparation of Two-Component Developer]

With respect to each of the toners TA-1 to TA-5 and TB-1 to TB-6, 8 parts by mass of the toner for evaluation and 100 parts by mass of a carrier (a carrier produced by Powdertech Co., Ltd., volume median diameter ($D_{50}$): 35 μm, volume resistivity: $1.0\times10^7$ Ω·cm, saturation magnetization in an applied magnetic field of 3,000 ($10^3/4\pi\cdot A/m$): 70 $Am^2/kg$) for "TASKalfa8052ci", product of KYOCERA Document Solutions Inc., were mixed for 30 minutes using a shaker mixer ("TURBULA (registered Japanese trademark) mixer T2F", product of Willy A. Bachofen AG) to prepare a two-component developer for evaluation.

[Measurement of Minimum Fixable Temperature]

A multifunction peripheral (an evaluation apparatus obtained by modifying "TASKalfa8052ci", product of KYOCERA Document Solutions Inc., to enable adjustment of fixing temperature) was used for evaluation. The two-component developer prepared as described above was loaded into a cyan-color developing device of the evaluation apparatus, and toner for replenishment use (the toner being evaluated) was loaded into a cyan-color toner container of the evaluation apparatus.

A solid image (specifically, an unfixed toner image) having a size of 25 mm×25 mm was formed on evaluation paper ("COLORCOPY (registered Japanese trademark)", product of Mondi, A4 size, basis weight: 90 $g/m^2$) using the evaluation apparatus at a toner application amount of 1.0 $mg/cm^2$ under environmental conditions of a temperature of 23° C. and a relative humidity of 50%. Subsequently, the evaluation paper with the image formed thereon was passed through a fixing device of the evaluation apparatus. The lowest temperature at which the solid image (the toner image) was fixable to the evaluation paper (a minimum fixable temperature) was measured by increasing the fixing temperature of the fixing device from 100° C. in increments of 1° C. and determining whether or not the toner was fixable at each fixing temperature. Determination of whether or not the toner was fixable was carried out through a fold-rubbing test described below. Specifically, the evaluation paper passed through the fixing device was folded in half with a surface having the image formed thereon facing inward at a folding line crossing a center of the image, and a 1-kg brass weight covered with cloth was rubbed back and forth on the fold five times. Subsequently, the evaluation paper was opened up and a fold portion (a portion on which the solid image was formed) of the evaluation paper was observed. Then, the length of toner peeling of the fold portion (peeling length) was measured. The minimum fixable temperature was determined to be the lowest temperature among fixing temperatures for which the peeling length was no greater than 1 mm. The toner was evaluated as "being able to maintain low-temperature fixability" if the minimum fixable temperature thereof was 130° C. or lower, and as "being unable to maintain low-temperature fixability" if the minimum fixable temperature thereof was higher than 130° C.

<Evaluation of Heat-Resistant Preservability>

With respect to each of the toners TA-1 to TA-5 and TB-1 to TB-6, 2 g of the toner (the toner for evaluation) was added into a polyethylene vessel (capacity: 20 mL), and then the polyethylene vessel was sealed. Next, the sealed vessel was left to stand in a thermostatic chamber set at 58° C. for 3 hours. Thereafter, the toner was taken out of the vessel and cooled to room temperature (25° C.) to give an evaluation target.

The thus obtained evaluation target was placed on a 100-mesh sieve (pore size: 150 μm) of known mass. The mass of the toner before sifting was calculated by measuring the total mass of the sieve and the evaluation target thereon. Subsequently, the sieve was set in a powder property evaluation machine ("POWDER TESTER (registered Japanese trademark)" PT-X, product of Hosokawa Micron Corporation) and shaken for 30 seconds at an amplitude of 1.0 mm in accordance with a manual of the powder property evaluation machine to shift the evaluation target. After the sifting, the mass of toner that did not pass through the sieve was measured. An aggregation rate (unit: % by mass) was calculated in accordance with the following expression based on the mass of the toner before sifting and the mass of the toner after sifting. The toner was evaluated as "having excellent heat-resistant preservability" if the aggregation rate was 10% by mass or lower. The toner was evaluated as "having poor heat-resistant preservability" if the aggregation rate was higher than 10% by mass. Note that the "mass of toner after sifting" in the following expression means the mass of toner that did not pass through the sieve, which in other words is the mass of toner remaining on the sieve after the sifting.

$$\text{Aggregation rate} = 100\times\text{mass of toner after sifting}/\text{mass of toner before sifting}$$

Table 3 shows the aqueous macromolecule solution used, the terephthalic acid content, the minimum fixable temperature, and the aggregation rate of each of the toners TA-1 to TA-5 and TB-1 to TB-6. The symbol "-" in Table 3 indicates that the toner was not evaluable (measurable) as a toner including capsule toner particles due to failure of shell layer formation.

TABLE 3

| | Toner | Aqueous Macromolecule Solution used | Terephthalic acid content [mass ppm] | Minimum fixable temperature [° C.] | Aggregation rate [% by mass] |
|---|---|---|---|---|---|
| Example 1 | TA-1 | PB-1 | 52 | 128 | 3 |
| Example 2 | TA-2 | PB-2 | 76 | 126 | 7 |
| Example 3 | TA-3 | PB-3 | 89 | 125 | 9 |
| Example 4 | TA-4 | PB-6 | 53 | 128 | 4 |
| Example 5 | TA-5 | PB-7 | 55 | 129 | 7 |
| Comparative Example 1 | TB-1 | PB-4 | — | — | — |
| Comparative Example 2 | TB-2 | PB-5 | — | — | — |
| Comparative Example 3 | TB-3 | PB-4 | 114 | 123 | 46 |
| Comparative Example 4 | TB-4 | PB-5 | 116 | 123 | 52 |
| Comparative Example 5 | TB-5 | PL-1 | — | — | — |
| Comparative Example 6 | TB-6 | PL-1 | 116 | 124 | 57 |

In each of the toner particles included in the toners TA-1 to TA-5, the shell layer contained a branched macromolecule. In each of the toner particles included in the toners TA-1 to TA-5, the branched macromolecule in the shell layer included a repeating unit having an oxazoline group. As shown in Tables 1 and 3, in each of the toner particles included in the toners TA-1 to TA-5, the branched macromolecule satisfied the relationship represented by $r_B/r_L \leq 0.80$ between $r_B$ of the branched macromolecule in the shell layer and $r_L$ of the corresponding linear macromolecule. In each of the toners TA-1 to TA-5, the amount of the shell layers contained in the toner particles was at least 0.1 parts by mass and no greater than 1 part by mass relative to 100 parts by mass of the toner cores.

As shown in Table 3, the toners TA-1 to TA-5 each had a minimum fixable temperature of 130° C. or lower. That is, the toners TA-1 to TA-5 were able to maintain their low-temperature fixability. The toners TA-1 to TA-5 each had an aggregation rate of 10% by mass or lower. That is, the toners TA-1 to TA-5 had excellent heat-resistant preservability.

The shell layers could not be formed in the toners TB-1, TB-2, and TB-5. In each of the toner particles included in the toner TB-6, the shell layer contained no branched macromolecule. As shown in Tables 1 and 3, each of the toner particles included in the toners TB-3 and TB-4 had a $r_B/r_L$ value of greater than 0.80.

As shown in Table 3, the toners TB-3, TB-4, and TB-6 each had an aggregation rate of greater than 10% by mass. That is, the toners TB-3, TB-4, and TB-6 had poor heat-resistant preservability.

These results indicate that the toners according to the present disclosure can exhibit excellent heat-resistant preservability while ensuring their low-temperature fixability.

What is claimed is:

1. A toner comprising toner particles, wherein the toner particles each include a toner core containing a binder resin and a shell layer covering a surface of the toner core, the shell layers contain a branched macromolecule, the branched macromolecule includes a repeating unit having an oxazoline group, the branched macromolecule satisfies a relationship represented by $r_B/r_L \leq 0.80$, where $r_B$ represents a radius of gyration of the branched macromolecule when an absolute molecular weight of the branched macromolecule is 40,000, and $r_L$ represents a radius of gyration of a linear macromolecule including a main chain having the same structure as a main chain of the branched macromolecule when an absolute molecular weight of the linear macromolecule is 40,000, $r_B$ and $r_L$ are each a radius of gyration measured by gel permeation chromatography using a multi-angle laser light scattering detector, the binder resin includes a polyester resin, the repeating unit has an oxazoline group that is a repeating unit represented by formula (1-1) shown below, the branched macromolecule further includes a unit derived from a polymerization initiation group-containing compound, the polymerization initiation group-containing compound has three or more polymerization initiation groups in a molecule thereof, and the polymerization initiation groups are each represented by formula (A) shown below, (1-1)

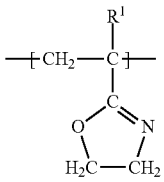

where in formula (1-1), $R^1$ represents a hydrogen atom or an alkyl group optionally substituted with a phenyl group, (A)

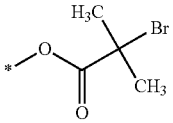

where in formula (A), an asterisk represents a site bonded to a portion of the polymerization initiation group-containing compound, the portion not being a polymerization initiation group.

2. The toner according to claim 1, wherein the polyester resin includes a repeating unit derived from terephthalic acid, and an amount of terephthalic acid contained in supernatant obtained by mixing 2 g of the toner and 50 g of distilled water at a temperature of 50° C. under stirring and centrifuging a resultant mixture is no greater than 100 mass ppm.

3. The toner according to claim 1, wherein the radius of gyration of the branched macromolecule when the absolute molecular weight of the branched macromolecule is 40,000 is at least 20 nm and no greater than 30 nm.

4. The toner according to claim 1, wherein $r_B/r_L$ is at least 0.60.

5. The toner according to claim 1, wherein the polymerization initiation group-containing compound is a compound represented by formula (A-1), (A-2), or (A-3) shown below, (A-1)

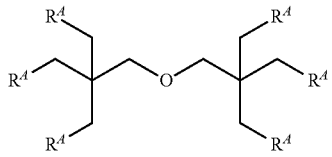

(A-2)

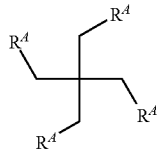

(A-3)

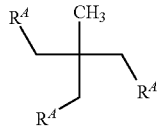

where in formulae (A-1), (A-2), and (A-3), $R^A$ represents a polymerization initiation group represented by formula (A).

* * * * *